US009871315B1

(12) United States Patent
Huang

(10) Patent No.: US 9,871,315 B1
(45) Date of Patent: Jan. 16, 2018

(54) ELECTRICAL CONNECTOR FOR CONNECTION TO A TRANSMISSION CONNECTOR ON A DEVICE

(71) Applicant: Din Yi Industrial Co., Ltd., New Taipei (TW)

(72) Inventor: Ching Kun Huang, New Taipei (TW)

(73) Assignee: Din Yi Industrial Co., Ltd., New Taipei (TW)

( * ) Notice: Subject to any disclaimer, the term of this patent is extended or adjusted under 35 U.S.C. 154(b) by 0 days.

(21) Appl. No.: 15/479,686

(22) Filed: Apr. 5, 2017

(51) Int. Cl.
*H01R 9/05* (2006.01)
*H01R 13/426* (2006.01)
*H01R 13/115* (2006.01)

(52) U.S. Cl.
CPC ..... *H01R 13/426* (2013.01); *H01R 13/115* (2013.01)

(58) Field of Classification Search
CPC . H01R 2103/00; H01R 9/0521; H01R 9/0518
USPC ..... 439/578, 583–585
See application file for complete search history.

(56) References Cited

U.S. PATENT DOCUMENTS 6,872,091 B2 * 3/2005 Huang ..... H01R 24/46 200/51.1
7,736,180 B1 * 6/2010 Paynter ..... H01R 4/5083 439/441
7,803,018 B1 * 9/2010 Islam ..... H01R 13/15 439/578
7,824,215 B2 * 11/2010 Islam ..... H01R 9/0527 439/578
8,047,870 B2 * 11/2011 Clausen ..... H01R 9/0524 439/578
8,206,176 B2 * 6/2012 Islam ..... H01R 13/565 439/578

* cited by examiner

*Primary Examiner* — Thanh Tam Le
(74) *Attorney, Agent, or Firm* — Rabin & Berdo, P.C.

(57) ABSTRACT

An electrical connector includes a housing internally defining a receiving passage having a front installation hole and a rear stop hole; an inner cap assembled to an inner side of the stop hole and internally defining a mounting passage; a pad assembled to an inner side of the installation hole and internally defining a holding passage; a conductor extended through and held in the holding passage with a forward exposed conducting pin section; and a flat spring member having a rear abutting end mounted in the mounting passage and a front clamping end riveted to a rear end of the conductor and forward pressed against a rear end surface of the pad, such that a spacing chamber is defined between an inner wall surface of the housing and the flat spring member. Therefore, the electrical conductor has fewer parts than conventional electrical connectors to enable reduced assembling complexity and time.

5 Claims, 7 Drawing Sheets

ELECTRICAL CONNECTOR FOR CONNECTION TO A TRANSMISSION CONNECTOR ON A DEVICE

FIELD OF THE INVENTION

The present invention relates to a cable/cord connector, and more particularly to an electrical connector structure that can be connected to a transmission connector on an electrical or an electronic device.

BACKGROUND OF THE INVENTION

Most electronic devices or computer, communication and consumer (3C) products include a connecting terminal provided on an outer surface thereof for electrically connecting with other electronic devices to transmit electrical signals. Various types of signal transmission connectors have become indispensable to enable data transmission between electronic devices and electrical connection between an electronic device and other peripherals. Two different electrical connecting terminals can be electrically connected to one another via a cable having corresponding connector interfaces at two opposite ends. Since various electrical connecting terminals are different in specification and the number of conductors, some fool-proof design is needed to avoid error connection of different types of electrical connecting terminals.

FIGS. 1 to 3 are longitudinal sectional, exploded perspective and partially enlarged sectional views, respectively, of a conventional electrical connecting terminal 1, which includes a protective shell 10, and a pin-shaped conductor 11 arranged in the protective shell 10 along a central line thereof. The pin-shaped conductor 11 has a front end projected beyond the protective shell 10, and a rear end located in the protective shell 10 and clamped in place by a resilient member 12.

As can be clearly seen in FIGS. 1 to 3, while the resilient member 12 clamps the pin-shaped conductor 11 in place, an inner cap 13, a stopper 14 and a first washer 15 are fitted around the resilient member 12 to hold it in place in the protective shell 10. Further, an outer cap 16 is provided in the protective shell 10 to cover a rear end of the inner cap 13. The outer cap 16 simply presses against a part of the outer surface of the inner cap 13 without being in direct and solid contact with the inner cap 13. In addition to the first washer 15, a gasket 17 and a second washer 18 are further fitted around the pin-shaped conductor 11 for holding the front end of the pin-shaped conductor 11 in a stable state.

As can be seen in FIG. 3, which is a partially enlarged view of the circled area A of FIG. 1, the resilient member 12 has a front portion in contact with the stopper 14, a middle portion in contact with the inner cap 13, and a rear portion in contact with the outer cap 16. That is, the inner cap 13 and the outer cap 16 together apply pressure against the resilient member 12, so that the resilient member 12 can exert an enhanced and stable clamping force on the pin-shaped conductor 11.

To assemble the above-mentioned parts into the electrical connecting terminal 1, first clamp the resilient member 12 onto the rear end of the pin-shaped conductor 11, then fit the inner cap 13 around the pin-shaped conductor 11 from the front end thereof and fit the outer cap 16 around the resilient member 12. Thereafter, sequentially mount the first washer 15, the gasket 17 and the second washer 18 into the protective shell 10 to fit them around the pin-shaped conductor 11. Therefore, the conventional electrical connecting terminal 1 includes a large number of parts, which require more steps and time to assemble, preventing the electrical connecting terminal 1 from being assembled and produced in an automated manner.

SUMMARY OF THE INVENTION

A primary object of the present invention is to provide an electrical connector that has an improved structural design to have fewer parts and enable reduced assembling complexity and time, allowing highly efficient, automated part production and simplified, automated part assembling procedures.

Another object of the present invention is to provide an electrical connector that has an improved part structural design to include only one inner cap while enables firm and stable holding of a flat spring member with said one single inner cap.

A further object of the present invention is to provide an electrical connector that internally includes a first shoulder portion and a second shoulder portion, against which a pad and an inner cap are respectively pressed, such that the pad and the inner cap are stably held in place in the electrical connector while a displacement space is maintained between them, allowing a flat spring member located in the displacement space to store and release elastic energy.

To achieve the above and other objects, the electrical connector provided according to a preferred embodiment of the present invention includes a housing, an inner cap, a pad, a conductor and a flat spring member. The housing internally defines a receiving passage, which has two opposite ends, namely, an axially front end forming an installation hole and an axially rear end forming a stop hole. The inner cap is assembled to an axially inner side of the stop hole of the receiving passage and internally defines a mounting passage. The pad is assembled to an axially inner side of the installation hole of the receiving passage and internally defines a holding passage. The conductor is extended through and held in the holding passage of the pad with a conducting pin section forward exposed from the holding passage. The flat spring member has a front portion forming a clamping end and a rear portion forming an opposite abutting end; the abutting end is mounted in the mounting passage of the inner cap, while the clamping end is riveted to an end of the conductor opposite to the conducting pin section; the clamping end is forward pressed against a rear end surface of the pad; and a spacing chamber is defined between an inner wall surface of the housing and the flat spring member.

The electrical connector further includes a stopper, which is fitted around the conductor and located between the pad, the flat spring member and the conductor. With the stopper, the pad, the conductor and the flat spring member can be more stably, firmly and compressively held relative to one another.

The holding passage of the pad includes a first diameter corresponding to that of the conductor and a second diameter corresponding to an outer diameter of the stopper; and the second diameter is larger than the first diameter.

The mounting passage of the inner cap has an axially front end forming a connection hole and an axially rear end forming an insertion hole; and a stop space is defined in the mounting passage between the connection hole and the insertion hole. The connection hole is diametrically smaller than the stop space, so that the possibility for the flat spring member to separate from the inner cap via the connection hole is largely reduced.

The connection hole is outward extended and flared to form an inward tapered connection opening; and the insertion hole is also outward extended and flared to form an inward tapered insertion opening. The outward flared hole design allows the flat spring member to be easily and effortlessly slid into the inner cap via the tapered connection opening without the need of carefully aligning the flat spring member with the connection hole.

According to the present invention, the receiving passage of the housing includes three different bore sizes, namely, a first bore size, a second bore size and a third bore size, which are sequentially arranged and gradually reduced from the installation hole toward the stop hole, such that a first shoulder portion is formed in around the receiving passage at a position where the first bore size is changed into the second bore size, and a second shoulder portion is formed in around the receiving passage at another position where the second bore size is changed into the third bore size. The inner cap is rearward stopped by the second shoulder portion; and the pad is rearward stopped by the first shoulder portion.

The electrical connector of the present invention is characterized in that it is improved in part structural design and therefore includes fewer number of parts to reduce the assembling complexity and time thereof, enabling the electrical connector to be easily produced via highly efficient, automated part production and assembling procedures.

Further, the electrical connector of the present invention has an improved cap structural design to decrease the number of caps to only one inner cap, and said one single inner cap is sufficient to achieve the effect of stably and firmly holding the flat spring member in place.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
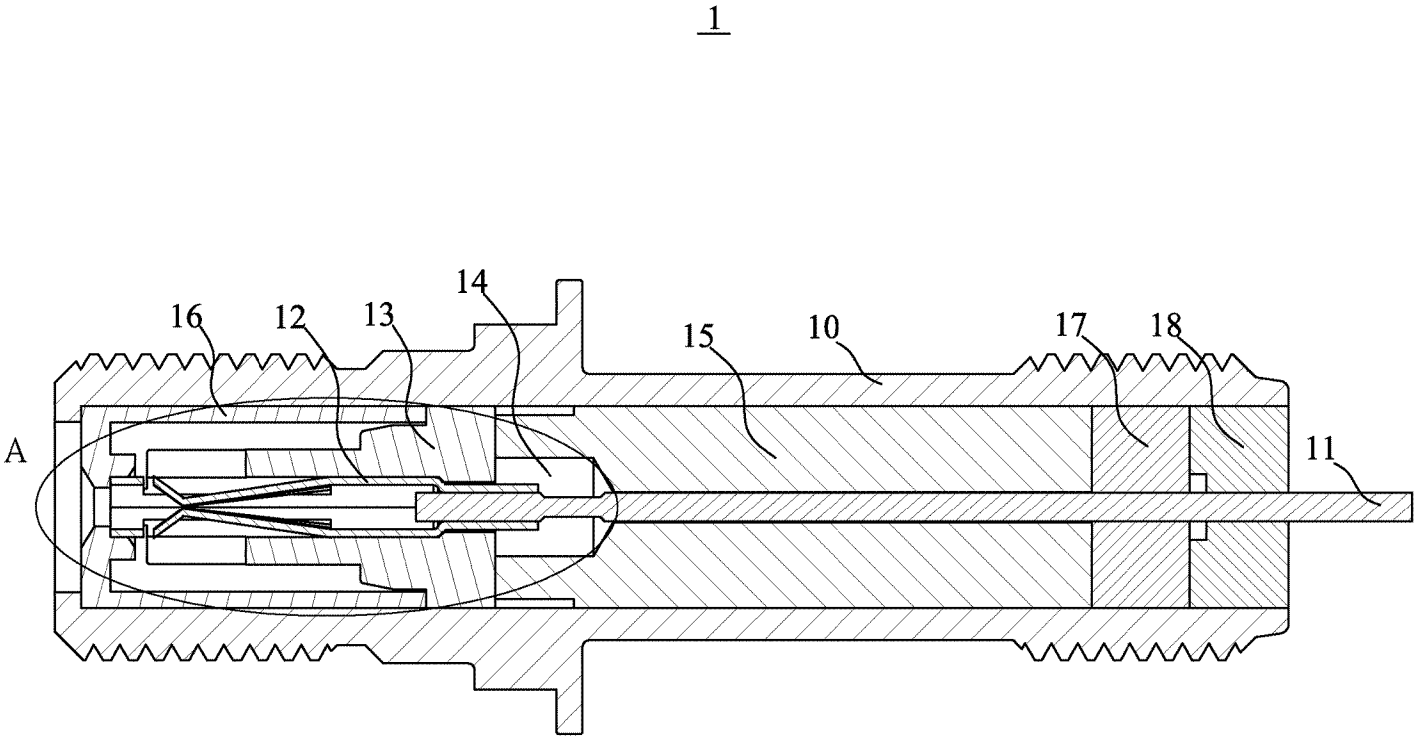
FIG. 1 (Prior Art)
FIG. 1 is an assembled longitudinal sectional view of a conventional electrical connecting terminal.
Figure 2:
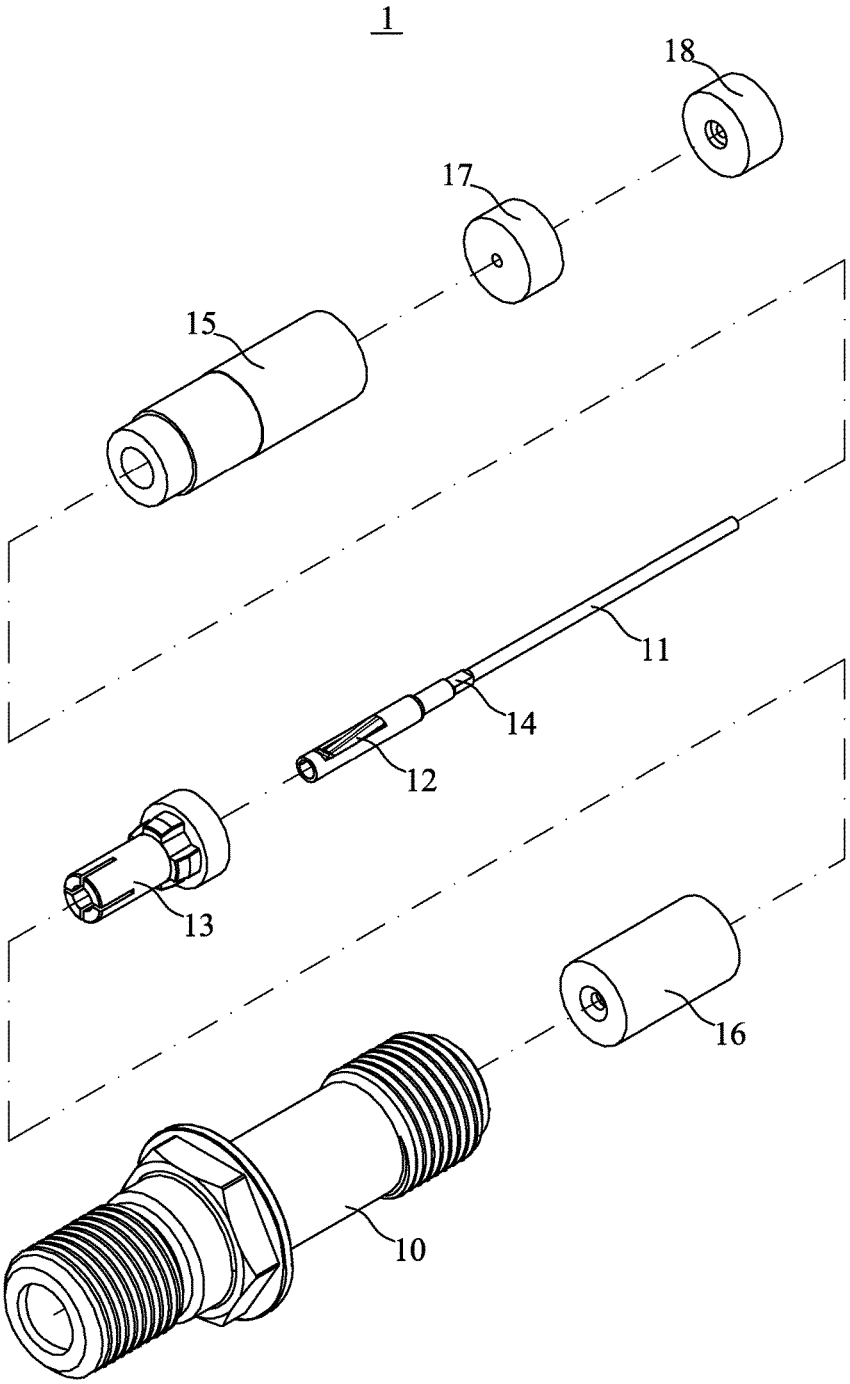
FIG. 2 (Prior Art)
FIG. 2 is an exploded perspective view of the conventional electrical connecting terminal of FIG. 1.
Figure 3:
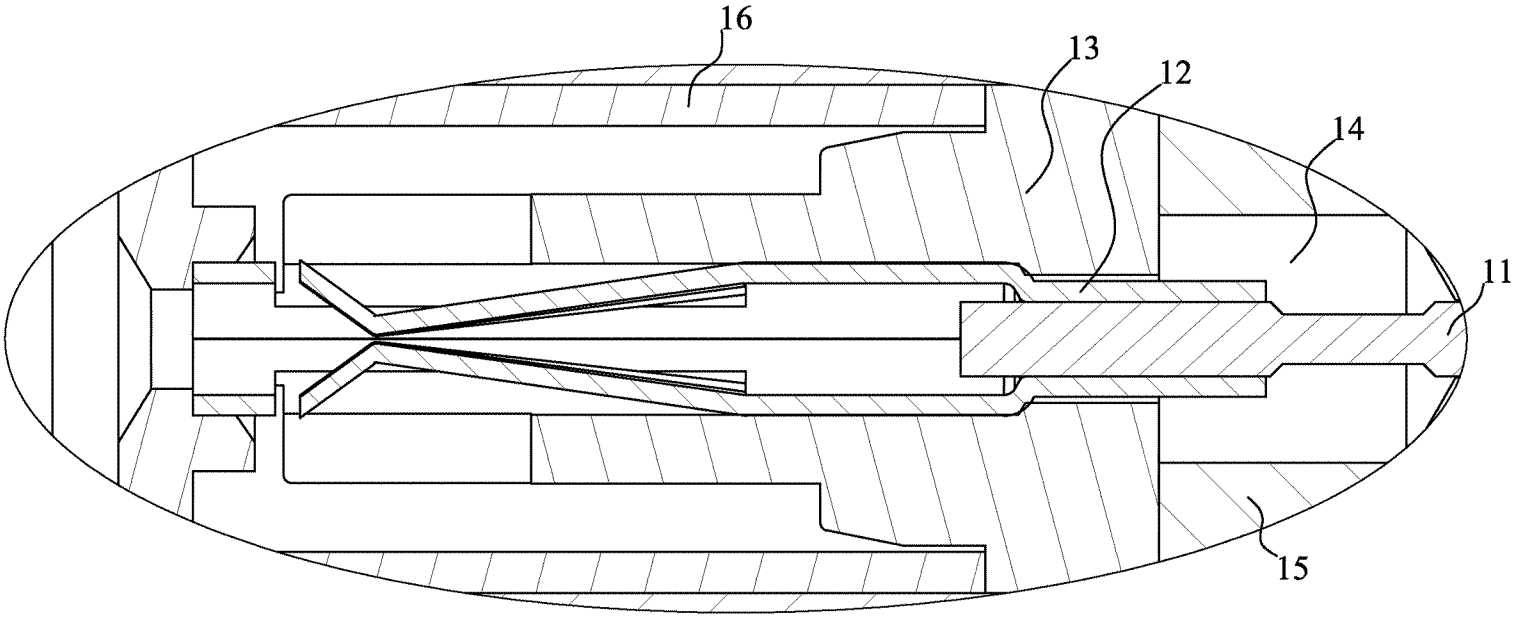
FIG. 3 (Prior Art)
FIG. 3 is an enlarged view of the circled area A of FIG. 1.
Figure 4:
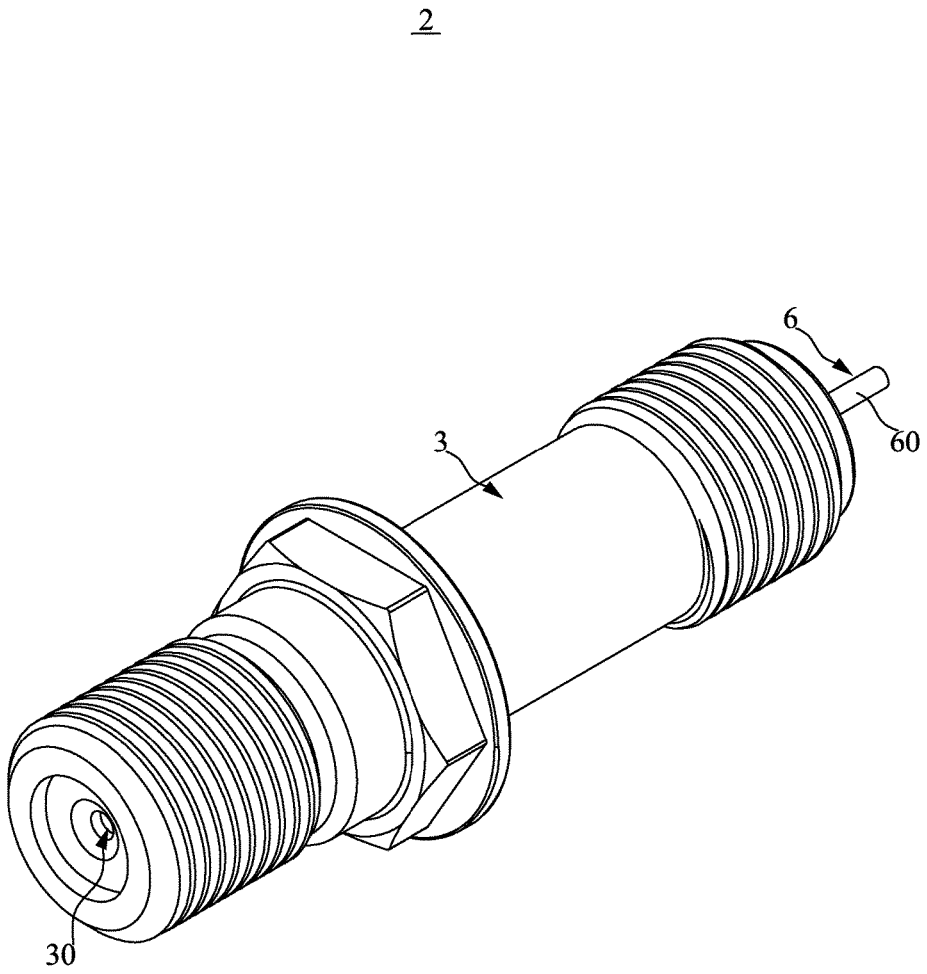
FIG. 4 is an assembled perspective view of an electrical connector according to a preferred embodiment of the present invention.

The present invention will now be described with a preferred embodiment thereof and by referring to the accompanying drawings.

Please refer to FIGS. 4 to 7. An electrical connector 2 according to a preferred embodiment of the present invention includes a housing 3, an inner cap 4, a pad 5, a conductor 6, a flat spring member 7 and a stopper 8, which constitute six major structural parts of the present invention.

The housing 3 is formed of an insulating plastic material for protectively enclosing other structural parts therein and protecting the internal parts against undesirable touch by users. The housing 3 internally defines a receiving passage 30, which has two opposite ends, namely, an axially front end forming an installation hole 31 and an axially rear end forming a stop hole 32.

The receiving passage 30 includes three different bore sizes, namely, a first bore size 301, a second bore size 302 and a third bore size 303, which are sequentially arranged and gradually reduced from the installation hole 31 toward the stop hole 32. More specifically, the first bore size 301 is corresponding to an outer diameter of the pad 5 and an inner diameter of the installation hole 31; the second bore size 302 is corresponding to an outer diameter of the inner cap 4; and the third bore size 303 is corresponding to an inner diameter of the stop hole 32.

A first shoulder portion 304 is formed in around the receiving passage 30 at a position where the first bore size 301 is changed into the second bore size 302. Also, a second shoulder portion 305 is formed in around the receiving passage 30 at another position where the second bore size 302 is changed into the third bore size 303.

The inner cap 4 is assembled to an axially inner side of the stop hole 32 of the receiving passage 30 to rearward press against the second shoulder portion 305. The inner cap 4 internally defines a mounting passage 40, which has an axially front end forming a connection hole 41 and an axially rear end forming an insertion hole 42.

A stop space 43 is defined in the mounting passage 40 between the connection hole 41 and the insertion hole 42. The connection hole 41 is diametrically smaller than the stop space 43, and is outward extended and flared to form an inward tapered connection opening 410. The insertion hole 42 is also outward extended and flared to form an inward tapered insertion opening 420.

The pad 5 is assembled to an axially inner side of the installation hole 31 of the receiving passage 30 to rearward press against the first shoulder portion 304, such that the first shoulder portion 304 serves as a final position, against which the pad 5 under compression is pressed and stopped from moving any further. The first shoulder portion 304, the second shoulder portion 305 and the pad 5 together define a space and distance within which the flat spring member 7 is allowed for a sideward movement to store and release its elastic energy.

The pad 5 internally defines a holding passage 50, which includes a first diameter 51 corresponding to that of the conductor 6 and a second diameter 52 corresponding to an outer diameter of the stopper 8. The second diameter 52 is larger than the first diameter 51.

The conductor 6 is extended through and held in the holding passage 50 of the pad 5 with a conducting pin section 60 forward exposed from the holding passage 50 for electrically contacting with other electronic elements.

Figure 5:
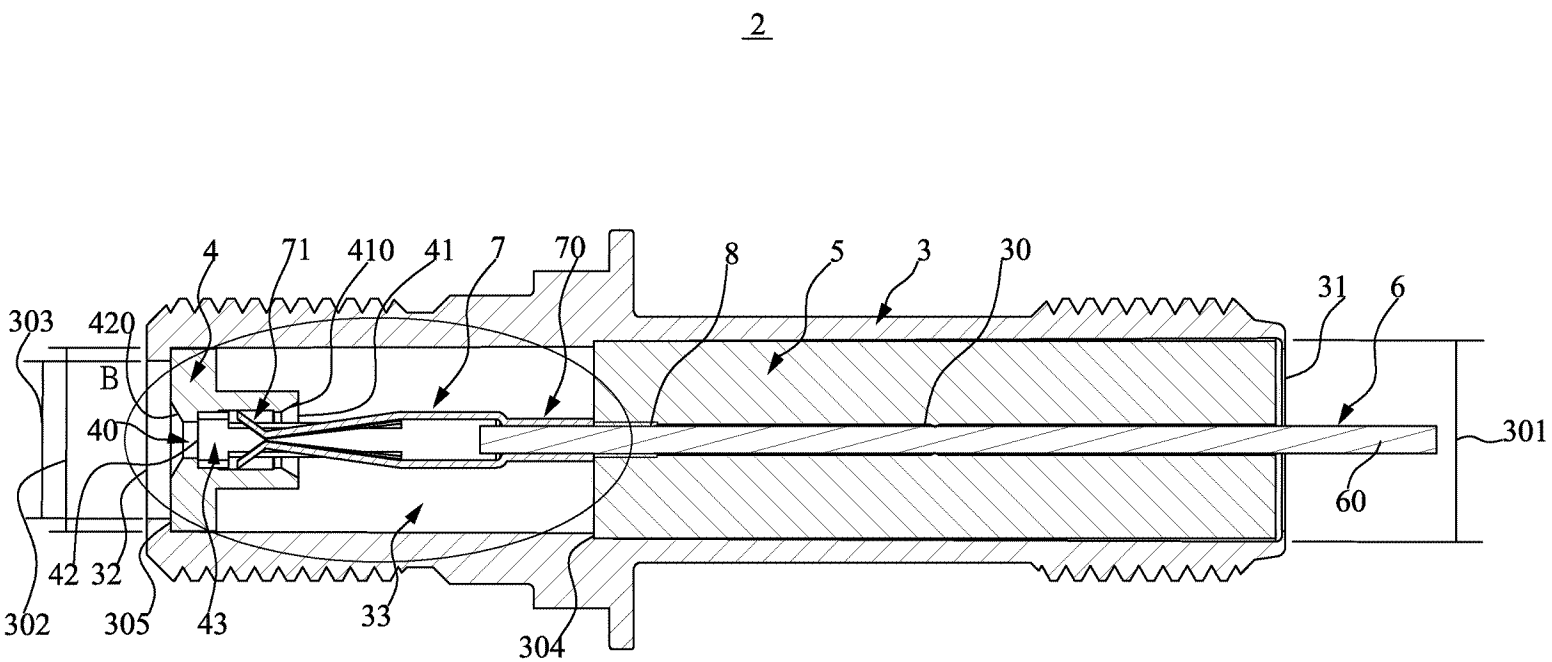
FIG. 5 is a longitudinal sectional view of FIG. 4.
Figure 6:
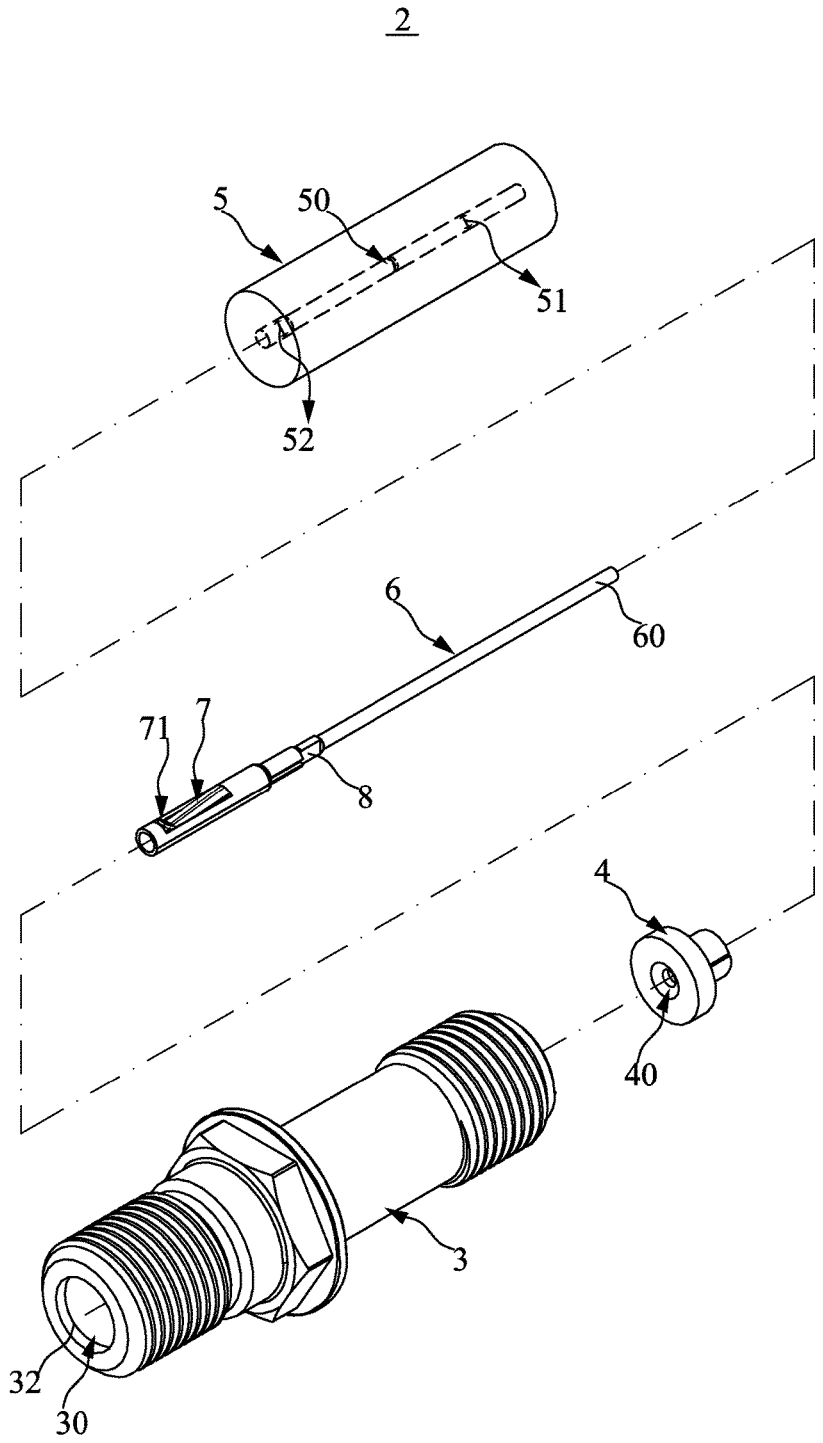
FIG. 6 is an exploded view of FIG. 4.
Figure 7:
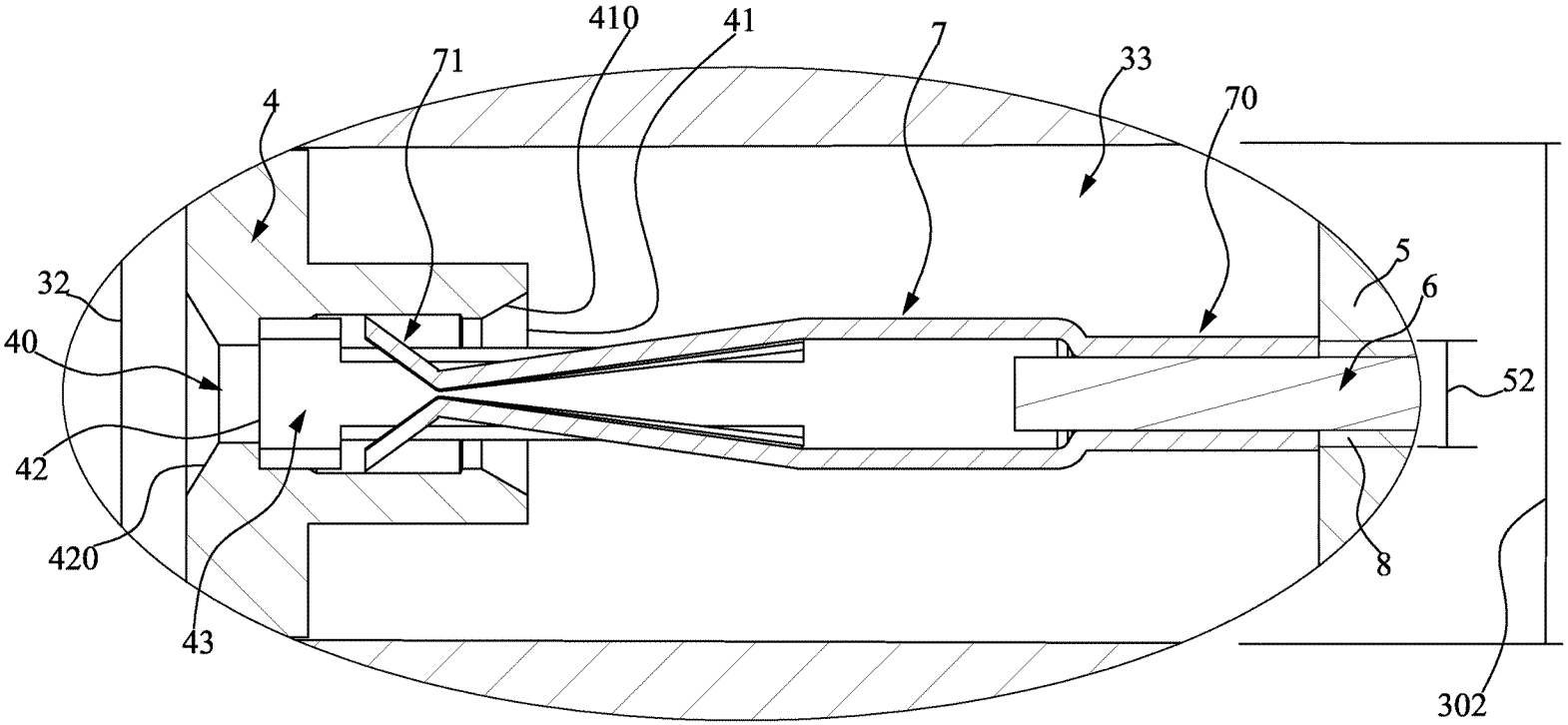
FIG. 7 is an enlarged view of the circled area B of FIG. 5.

The flat spring member 7 has a front portion forming a clamping end 70 and a rear portion forming an opposite abutting end 71. The abutting end 71 is mounted in the mounting passage 40 of the inner cap 4, while the clamping end 70 is riveted to an end of the conductor 6 opposite to the conducting pin section 60. Further, the clamping end 70 is forward pressed against a rear end surface of the pad 5. A spacing chamber 33 is defined between an inner wall surface of the housing 3 and the flat spring member 7. As can be seen in FIG. 5, the clamping end 70 and a substantial central section of the flat spring member 7 located between the clamping end 70 and the abutting end 71 are suspended in the spacing chamber 33.

When an external wire or cable is electrically coupled to the electrical connector 2 of the present invention, the abutting end 71 of the flat spring member 7 provides resilience in the stop space 43 and is capable of absorbing and releasing elastic energy.

The stopper 8 is fitted around the conductor 6 and located between the pad 5, the conductor 6 and the flat spring member 7. The provision of the stopper 8 enables the pad 5, the conductor 6 and the flat spring member 7 to be more stably, firmly and compressively held relative to one another.

It is to be noted that the electrical connector 2 of the present invention is assembled in the following steps or manner. In a first step or stamp forming step, the conductor 6 and the flat spring member 7 are simultaneously formed by stamping and riveted to each other; and in a second step or assembling step, the conductor 6 with the flat spring member 7 riveted thereto is then extended into the inner cap 4 and the pad 5 at the same time to complete the assembling of the electrical connector 2. With the above steps for assembling the present invention, the resilient member 12 and the pin-shaped conductor 11 that are used and soldered together in the conventional electrical connecting terminal 1 can be omitted to avoid the problems of uneven thickness at the soldered metal materials and complicated part assembling.

According to the electrical connector 2 of the present invention, only one inner cap 4, one single pad 5 and one single stopper 8 are needed to cooperatively press against two axially opposite ends of the flat spring member 7. More specifically, the pressure applied by the inner cap 4 to the abutting end 71 of the flat spring member 7 and the pressure applied by the pad 5 and the stopper 8 to the clamping end 70 of the flat spring member 7 are in two opposite directions, bringing the flat spring member 7 to firmly clamp the conductor 6 in place.

Compared to the conventional electrical connecting terminal 1, which requires one inner cap 13, one outer cap 16, more than one washer 15, 18 and one gasket 17 to hold the resilient member 12 in place, the electrical connector 2 of the present invention has fewer parts while achieves similar or equivalent function of holding the flat spring member 7 in place. Therefore, the electrical connector 2 of the present invention has simplified structure to reduce the assembling complexity and time, enabling the parts of the electrical connector 2 to be more easily produced and assembled in an automated manner.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An electrical connector, comprising:

a housing internally defining a receiving passage; the receiving passage having two opposite ends, namely, an axially front end forming an installation hole and an axially rear end forming a stop hole;

an inner cap being assembled to an axially inner side of the stop hole of the receiving passage and internally defining a mounting passage;

a pad being assembled to an axially inner side of the installation hole of the receiving passage and internally defining a holding passage;

a conductor being extended through and held in the holding passage of the pad with a conducting pin section forward exposed from the holding passage; and a flat spring member having a front portion forming a clamping end and a rear portion forming an opposite abutting end; the abutting end being mounted in the mounting passage of the inner cap, while the clamping end being riveted to an end of the conductor opposite to the conducting pin section; the clamping end being forward pressed against a rear end surface of the pad; and a spacing chamber being defined between an inner wall surface of the housing and the flat spring member;

wherein the receiving passage of the housing includes three different bore sizes, namely, a first bore size, a second bore size and a third bore size, which are sequentially arranged and gradually reduced from the installation hole toward the stop hole; a first shoulder portion being formed in around the receiving passage at a position where the first bore size is changed into the second bore size, and a second shoulder portion being formed in around the receiving passage at another position where the second bore size is changed into the third bore size; the inner cap being rearward stopped by the second shoulder portion; and the pad being rearward stopped by the first shoulder portion.

2. The electrical connector as claimed in claim 1, further comprising a stopper; and the stopper being fitted around the conductor and located between the pad, the flat spring member and the conductor.

3. The electrical connector as claimed in claim 2, wherein the holding passage of the pad includes a first diameter corresponding to that of the conductor and a second diameter corresponding to an outer diameter of the stopper; and the second diameter being larger than the first diameter.

4. The electrical connector as claimed in claim 1, wherein the mounting passage of the inner cap has an axially front end forming a connection hole and an axially rear end forming an insertion hole; a stop space being defined in the mounting passage between the connection hole and the insertion hole; and the connection hole being diametrically smaller than the stop space.

5. The electrical connector as claimed in claim 4, wherein the connection hole is outward extended and flared to form an inward tapered connection opening; and the insertion hole is also outward extended and flared to form an inward tapered insertion opening.

* * * * *